United States Patent [19]

Bernasconi et al.

[11] 3,982,849

[45] Sept. 28, 1976

[54] LOW PRESSURE STEAM TURBINE CONSTRUCTION

[75] Inventors: Felix Bernasconi, Zollikerberg, Switzerland; Heinz Brünner, Walshut, Germany; Pierre Meylan, Neuenhof, Switzerland

[73] Assignee: BBC Brown Boveri & Company Limited, Baden, Switzerland

[22] Filed: Apr. 23, 1975

[21] Appl. No.: 570,629

[30] Foreign Application Priority Data

Dec. 16, 1974 Switzerland ..... 16791/74

[52] U.S. Cl. ..... 415/101; 415/201; 415/219 R; 415/203

[51] Int. Cl.[2] ..... F01D 3/02

[58] Field of Search ..... 415/100, 101, 102, 103, 415/201, 219 R, 205, 203

[56] References Cited

UNITED STATES PATENTS

| | | | |
|---|---|---|---|
| 2,122,235 | 6/1938 | Millarol | 415/201 |
| 3,313,517 | 4/1967 | Hanschke et al. | 415/101 |
| 3,610,770 | 10/1971 | Hendriks | 415/103 |
| 3,738,770 | 6/1973 | Bolter | 415/101 |
| 3,881,843 | 5/1975 | Meylan | 415/219 R |

*Primary Examiner*—Henry F. Raduazo
*Attorney, Agent, or Firm*—Pierce, Scheffler & Parker

[57] ABSTRACT

A low pressure multi-stage axial flow steam turbine comprises an outer housing and an inner housing structure constituting a carrier for the rows of guide blading of the various stages. A steam inflow housing located within the inner housing structure forms the boundary of a crescent-shaped intake duct which surrounds and admits steam to the first stage guide blading which flows through the duct in the same direction as that in which the turbine rotor rotates, and the cross sectional area of the intake duct decreases progressively in the direction of steam flow therethrough such that the tangential components of the steam velocity conform to a predetermined function. The curvature of the intake duct at the inner periphery thereof increases progressively in the direction of steam flow therethrough such that the radial components of the steam velocity conform to a second predetermined function. The two functions can be correlated such that the tangential and radial components of the steam velocity are at least approximately equal to each other for the same cross sectional locations along the duct. One crescent-shaped intake duct which supplies steam to the entire periphery of the first stage guide blading may be utilized, or two such ducts may be utilized, each supplying steam to one-half the periphery of the guide blading.

4 Claims, 6 Drawing Figures

LOW PRESSURE STEAM TURBINE CONSTRUCTION

The present invention relates to an improved construction of a thermal turbo-machine, and particularly a low-pressure steam turbine, with an inflow housing comprising at least two separate parts which form the boundaries for at least one intake duct, which serves to guide the working medium, e.g. steam to the first stage stationary row of guide blading.

The inner housings of single or twin-inlet, large sized low-pressure steam turbines are usually designed in single, or multi-shelled form. The steam is furnished by a steam-supplying source, e.g. a water separator and intermediate superheater, by way of pipe lines which pass through the outer housing and end at an intake duct which leads to an inflow housing, arranged within the inner turbine housing. The profile of the intake duct can have a trapezoidal or circular shape among other possible configurations. Through this intake duct which surrounds the first row of guide blading of the turbine and which is open in the direction of this row, there will flow the steam in a circumferential direction as well as in a radially inward direction, thereby providing the entire first row of guide blading and thus the entire turbine, with the required quantity of steam. In order to attain an advantageous thermal efficiency of the turbine, it is desirable to distribute the steam as uniformly as possible, and to keep to a minimum the flow losses which will increase with the extent and number of the steam-deflecting parts, and the square of the steam velocity.

In previously known constructions of low-pressure steam turbines, the intake duct has a circular configuration, its cross sectional areas along the duct perimeter are constant and essentially circular in the form of a torus. The steam flows into the intake duct by way of two inlet nozzles which direct the steam inside the intake duct during the continuous change in flow velocity in such manner that one-half of the full quantity of steam being supplied will enter in a direction which is opposite to the direction in which the turbine rotor rotates, whereupon the guide blading of the first row will deflect the steam to said direction of rotation. The great number of necessary deflections of the flow, until the blading channel has been reached will cause losses which, in the case of high flow velocities, can amount to a multiple of the kinetic inflow energy within the inlet nozzle. It is for this reason that the average flow velocity within the intake duct is kept at a low order, an arrangement which will limit the losses but on the other hand will result in excessive profile dimensions for the intake duct and the inlet nozzles. Such dimensions adversely influence the overall axial size of the machine, the feasible turbine power output, the expenses for materials, the weight per unit of power, and the costs for the manufacture of the turbine. Other additional disadvantages arise at the time of turbine inspections.

The principal object of the present invention is to provide an improved construction for the turbine which will avoid the disadvantages attending known turbo-machines of the above-referred to type, and particularly the invention provides an improved steam inflow system which is so constructed as to make it impossible to arrive at lesser dimensions without lowering the turbine output, or without a change in dimension to attain a greater output per unit of power.

In accordance with the invention, the improved result is achieved in that each intake duct is designed to supply one specific peripheral portion of the first row, i.e. first stage of the stationary guide blading, the direction of steam flow therethrough being the same as the direction of rotation of the turbine rotor, and with respect to each intake duct, the cross-sectional areas of a curved section of the duct decrease in the direction of steam flow and in such manner that the tangential components of the steam velocity behave in conformity with a predetermined first function, and that the values of curvature at the inner circumferential area of the curved section increase in the direction of steam flow and in such manner that the radial components of the steam velocity behave in conformity with a predetermined second function.

The advantages of the improved turbo-machine construction as proposed by the invention, in comparison with presently known turbo-machine constructions are primarily the following:

The flow direction of the working steam will conform within the entire intake duct to the direction of rotation of the turbine rotor, thus reducing substantially the number and the extent of the deflection which are necessary until the steam enters the blading.

When the steam reaches the blading, the slope of its attack angle stays within such limits that there is hardly any need for a row of entrance blading to accomplish a deflection of the steam.

With the quantity of steam to be supplied remaining unchanged, it will now be possible to employ greater steam flow velocities and/or intake ducts with smaller dimensions. For example, a known torus-shaped intake duct with an internal diameter of 750 mm and an inlet nozzle of 1,000 mm internal diameter will permit a flow velocity of approximately 60 m/sec. while in the case of an intake duct designed according to the present invention, with an internal diameter of 700 mm and an inlet nozzle of only 700 mm internal diameter, a flow velocity of 120 m/sec. can be achieved, all other flow losses being equal.

The smaller dimensions of the intake duct, and consequently of the inflow housing and the inlet nozzles, result in a reduced overall axial size of the turbo-machine, thus making possible a substantial simplification of its entire construction. It will now be feasible, for example, to manufacture the inflow housing and the guide blading carrier, supporting the entire guide blading system, with the exception of the last stage of the machine, in one piece. By accommodating two bleed chambers inside the guide blading carrier, it becomes possible to omit the formerly necessary separating walls within the inner housing, and to relieve at the same time this housing from thermal stresses. This makes possible also savings in usage of materials, thus lowering the weight of the machine and reducing its costs.

Due to the smaller dimensions of the intake ducts and their reduced cross-sectional areas within the plane of separation of the inflow housing parts, the forces pushing the latter away from each other are also substantially reduced so that a smaller number of bolts and/or smaller-sized bolts are required to fasten these parts together.

Several advantages can be obtained by arranging the inlet nozzles at the level of the turbine axis. The steam feed pipes can be positioned as desired, especially with sufficient head room so that service personnel can walk under the pipes without hinderance. If it should become necessary to remove the upper part of the inner housing for a check-up, it will no longer be necessary to remove the thermally movable seal between a bleed chamber of the inner housing and the exhaust chamber, but it will suffice simply to unfasten it. It can therefore, be stated that the machine can be inspected with ease.

Practical examples of the invention will now be described in detail and with the help of the accompanying drawings wherein:

FIG. 1 is an axial section, near the plane separating the parts of the inflow housing, through a known construction of a dual flow low-pressure steam turbine of the center inlet type employing an inner housing of multi-shell construction and a torus-shaped intake duct;

FIG. 2 is also an axial section of a low-pressure steam turbine similar to FIG. 1 but constructed in accordance with the present invention, there being two intake ducts with a decreasing cross-section area in the direction of steam flow, each duct supplying the steam to guide blading extending over one-half of the periphery of the guide blading row, and with the aadvantageous details of construction as a consequence of this arrangement.

Figure 3:
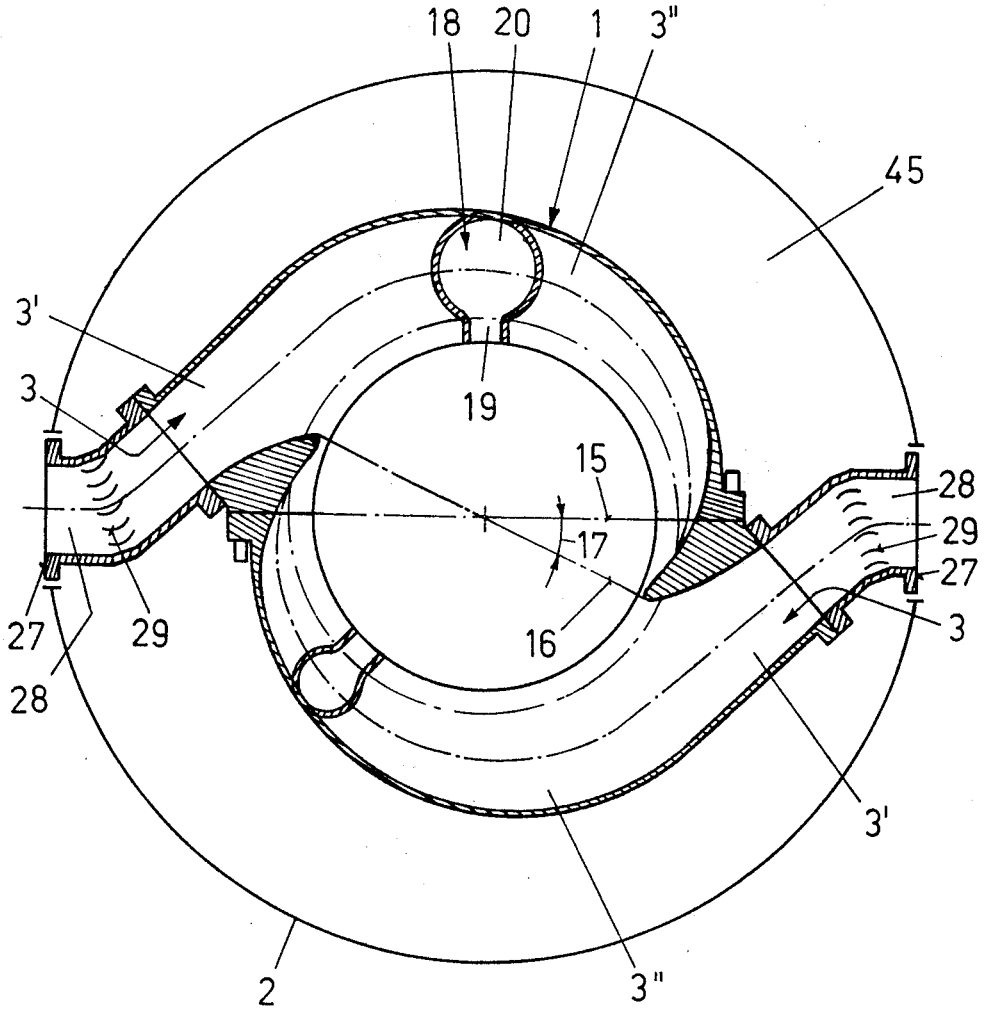
FIG. 3 is a radial cross-section, drawn to a larger scale, through the inner housing of the steam turbine illustrated in FIG. 2, with the intake ducts, the inflow housing parts and the inlet nozzles.
Figure 4:
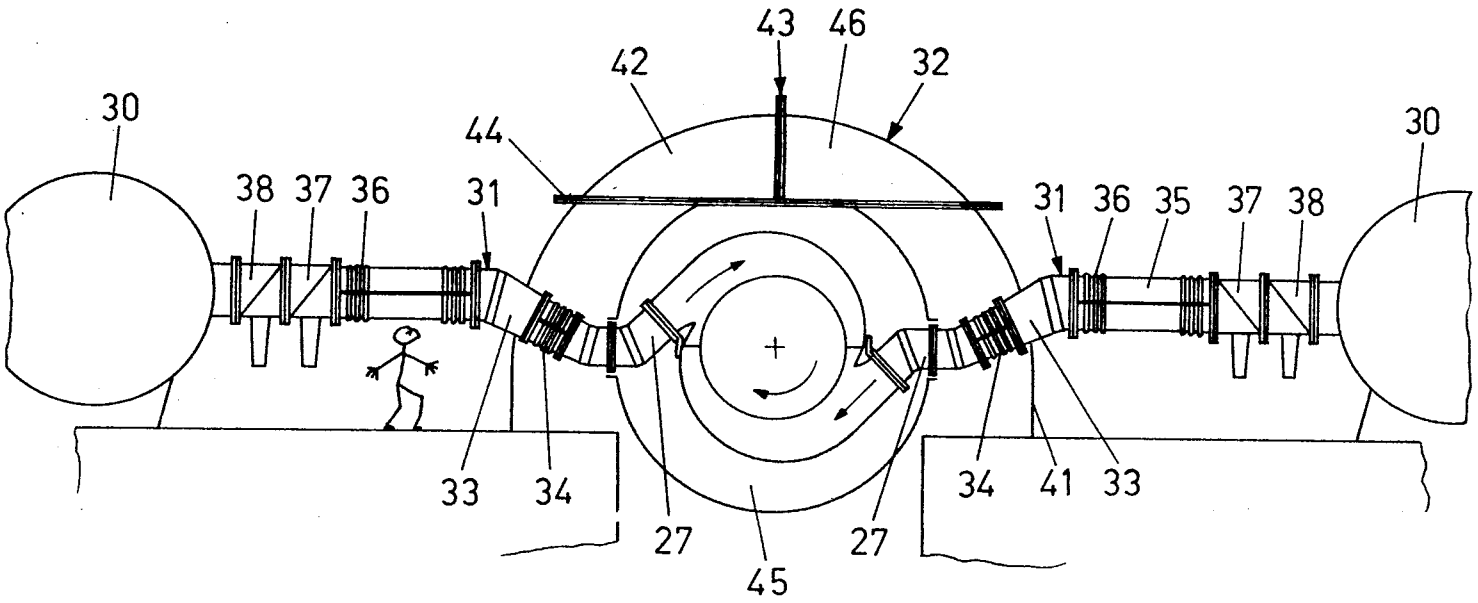
FIG. 4 is a side view of the turbine illustrated in FIGS. 2,3 and which also includes the outer housing and the location of the pipes supplying the steam to the turbine.
Figure 5:
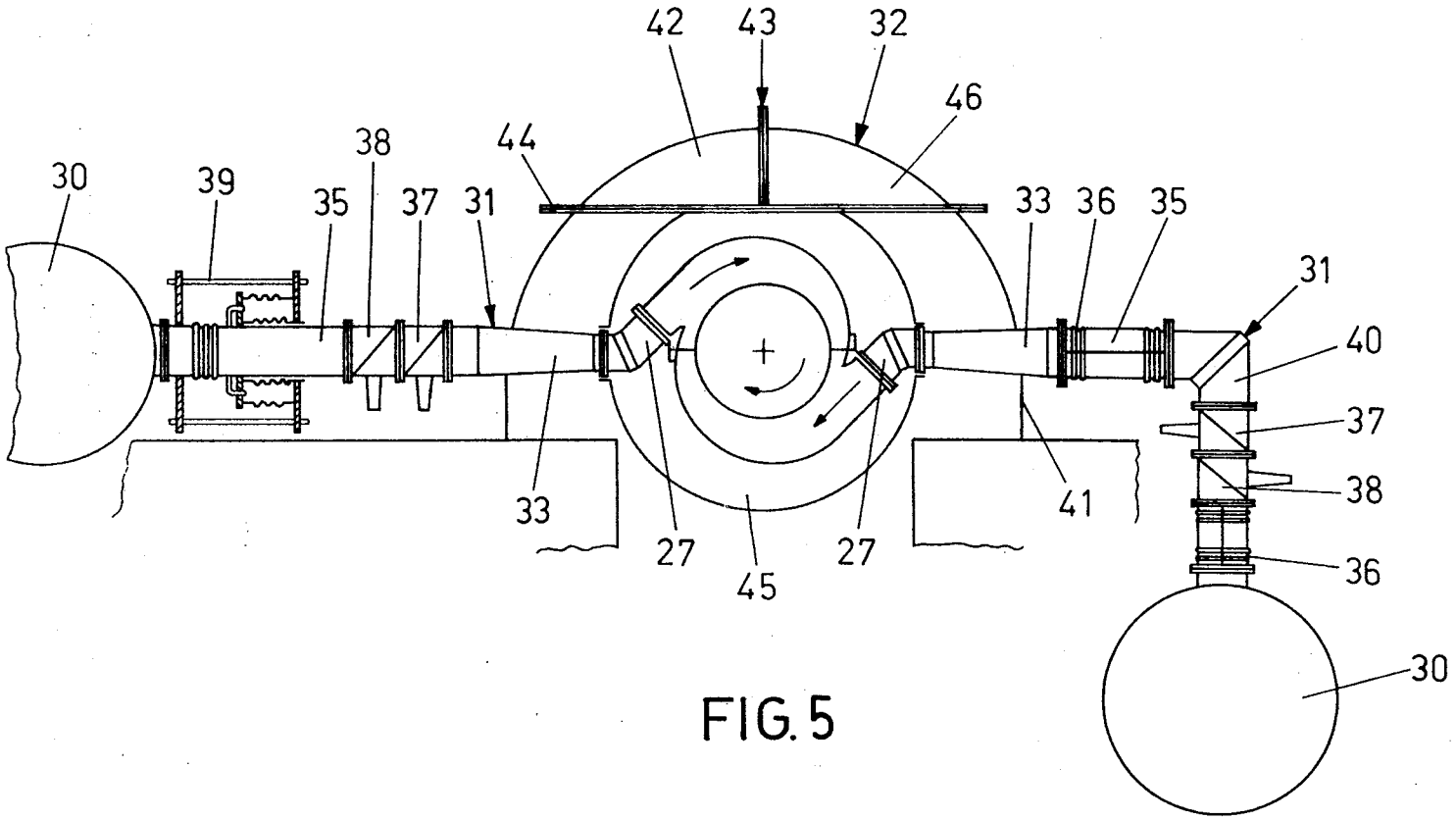
Figure 6:
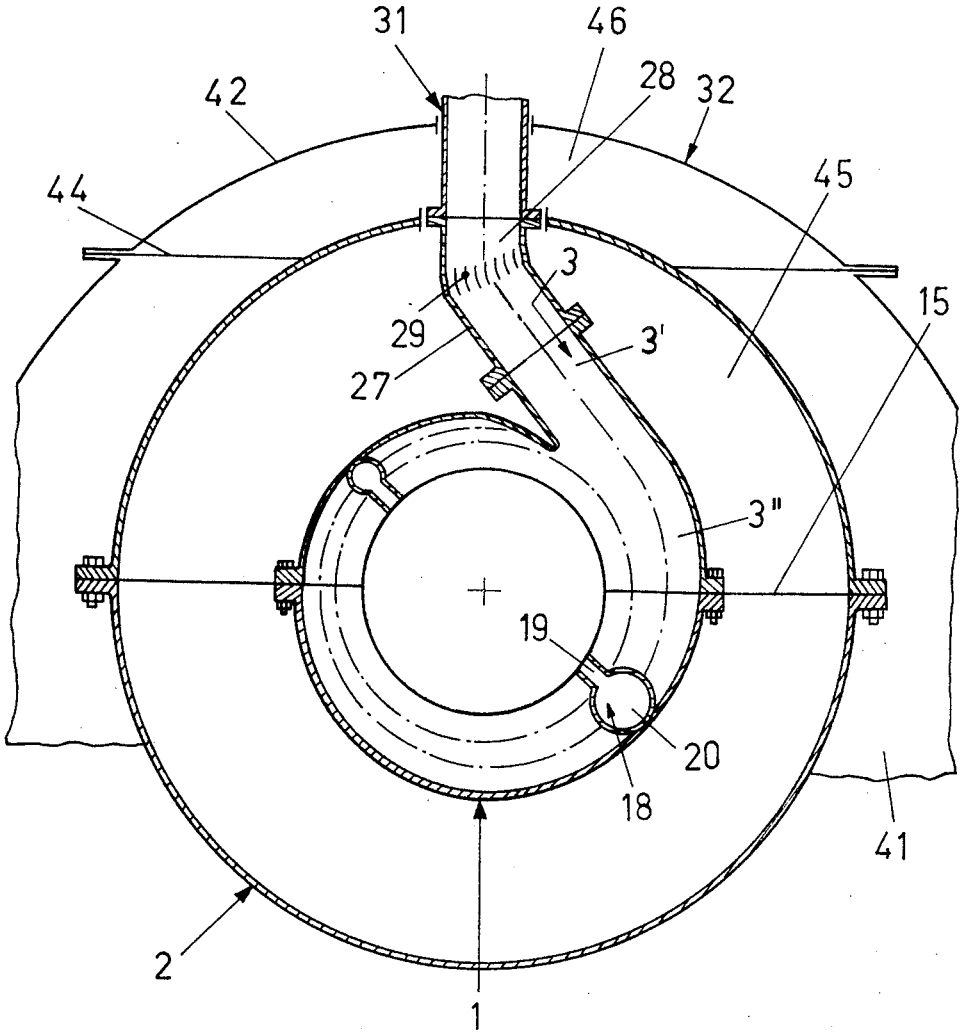

FIG. 5 is a view similar to FIG. 4 but showing a different arrangement of the steam supply pipes; and FIG. 6 is a radial cross section of a modified turbine construction, similar to FIG. 3, in accordance with the invention, which utilizes two inflow housing parts but only a single steam intake duct, the latter having a continuously decreasing cross-sectional area and supplying steam to the entire periphery of the guide blading row.

Identical components in the structures are denoted by the same reference numerals in all figures of the drawing.

Figure 1:
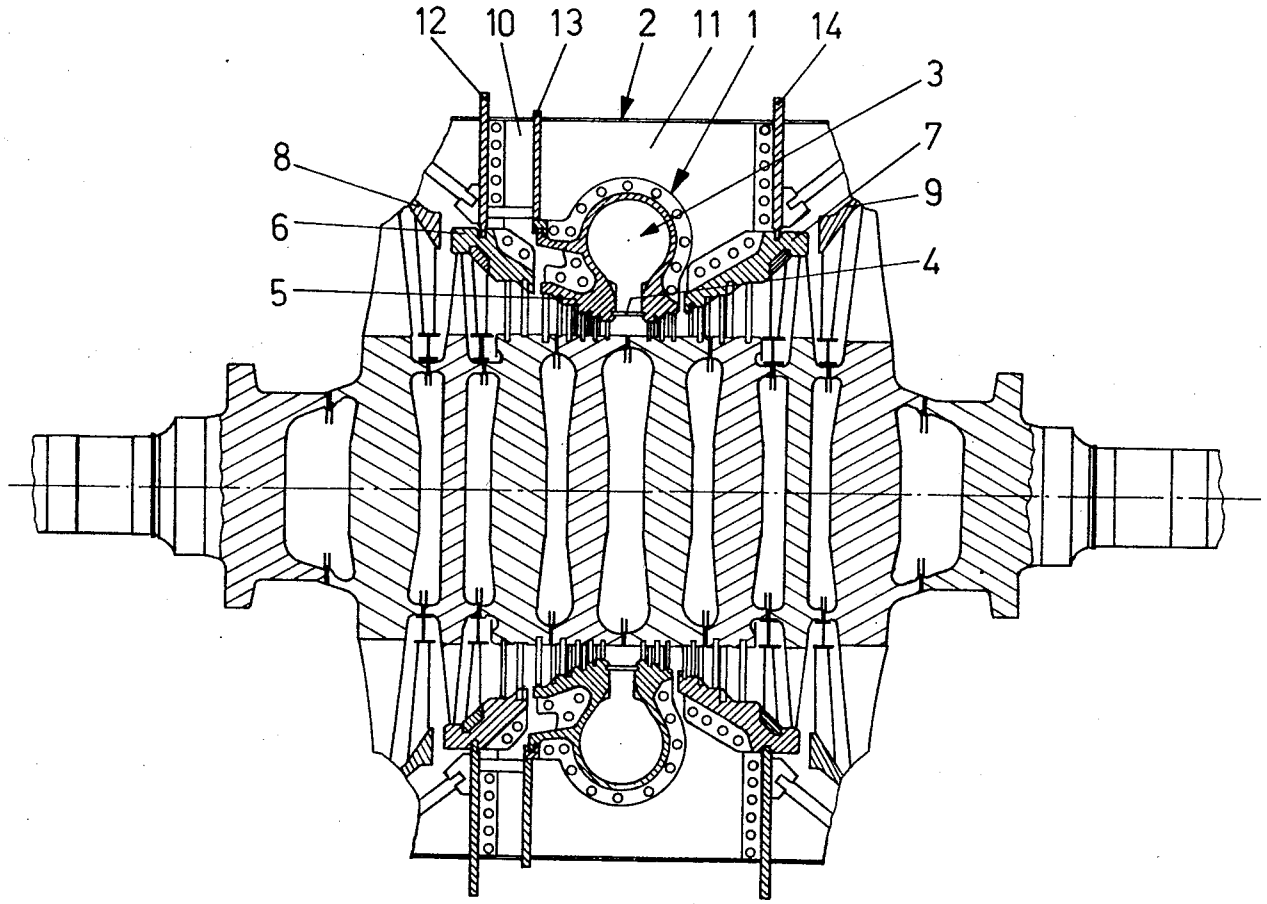

With reference now to FIG. 1, the low-pressure steam turbine, of known construction, is seen to be of the dual opposite flow type, the steam being admitted to a center inlet point and flowing in opposite directions through opposite multi-stage halves of the turbine. It includes an inflow housing 1, arranged within an inner housing 2, movable under the influence of heat and consisting of two halves. The intake duct 3 surrounds the first ring of guide blading 4 through which the steam flows in a radial direction. The duct 3 has a profile i.e. a cross section of a substantially circular cinfiguration, the profile remaining constant in the peripheral direction of the duct which thus takes the form of a torus. The inflow housing 1 and the carrier 5 for the central stationary guide blading row 4 are manufactured in one piece but there are provided in addition to the latter four other guide blading carriers 6, 7, 8 and 9 so that a total of five guide blade carriers are required to support the entire multi-stage guide blading system for the turbine. Furthermore, separating walls 12, 13 and 14 are provided to establish two bleed chambers 10 and 11 inside which steam is present in various phases, thus generating thermal stresses within the inner housing 2. Finally, this known construction is seen to be characterized by large axial dimensions of the inflow housing 1 and consequently of the turbine, by a great weight and a corresponding great use of materials.

Figure 2:
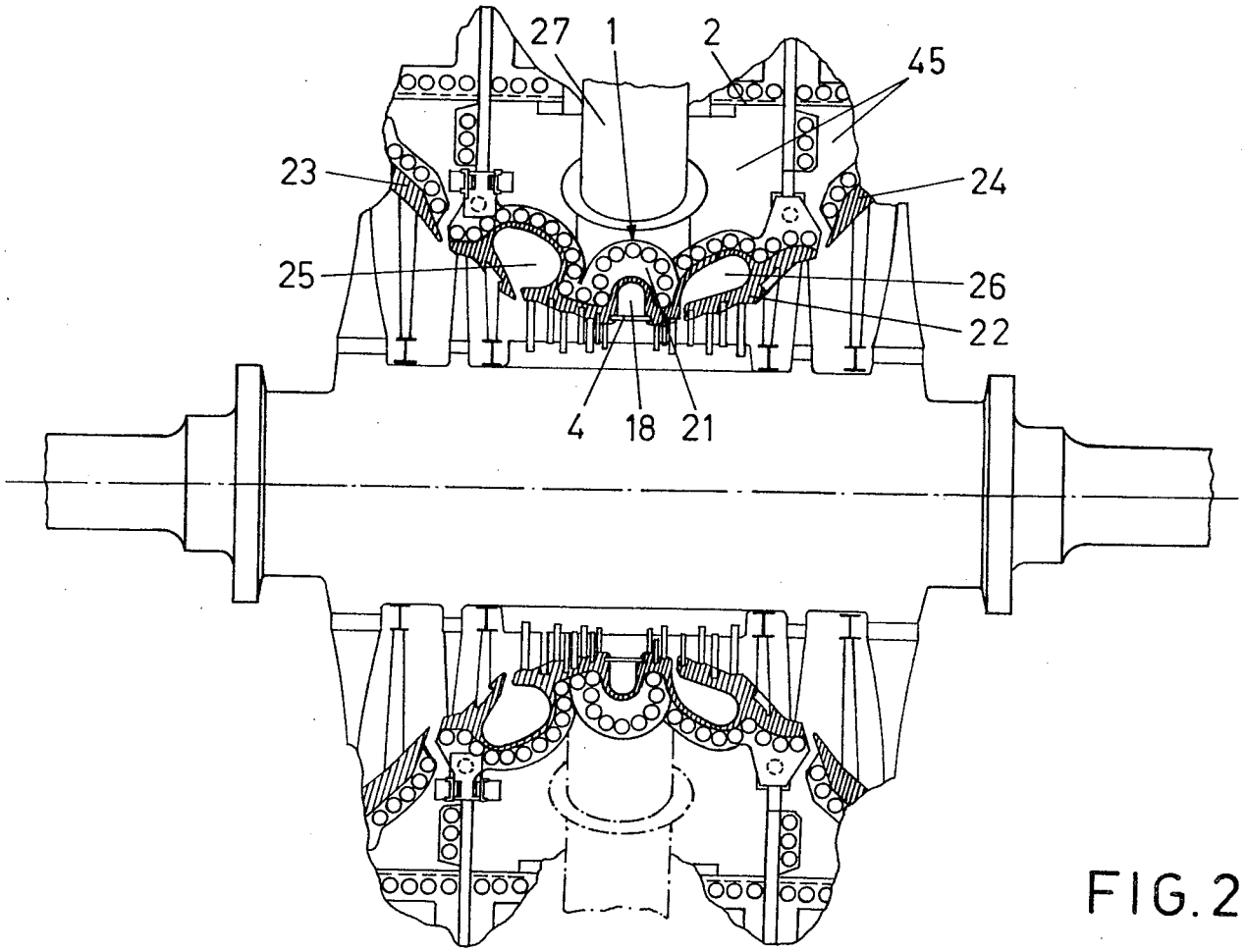

By way of contrast, the low-pressure steam turbine construction in accordance with the present invention as illustrated by FIGS. 2 and 3 includes an inflow housing 1 consisting of two components each with substantially crescent-shaped profiles which are connected with each other at a dividing plane 15, this plane being located at the level of the turbine axis. Two intake ducts 3 extend into the interior of the inflow housing 1 and form a junction there in such manner that a plane 16, placed across the tops of these ducts, forms an acute angle 17 with the separating plane 15. Each intake duct 3 has an inflow section 3' which changes over into a crescent-shaped section 3''. The inflow housing 1 surrounds the first ring 4 of guide blading for each half of the turbine and each intake duct 3 opening radially inwardly supplies steam to one-half of the guide blading ring 4. The cross-sectional areas 18 of the crescent-shaped sections 3'' of each intake duct 3 are not constant in the peripheral direction of the ducts 3 — as in the case of the previously described arrangement of FIG. 1 — but rather decrease in the direction of steam flow, which direction is the same as that in which the turbine rotor turns, and in such manner that the average tangential component of the steam velocity in the direction of flow will remain, at least substantially constant. Provision is made here for the fact that the amount of steam, flowing through intake duct 3, will decrease in the direction of flow by that amount of steam which is being radially inwardly lead off to the guide blading ring 4 through the open portion of the duct 3.

In addition to the change in cross-sectional areas, the radii of curvature, or the magnitude of the curvature respectively, of the inner circumferential area of the crescent-shaped section 3'' will also vary in the direction of steam flow. Specifically, the radii of curvature will decrease in the direction of steam flow, and the values of curvature will increase proportionally so that the average radial components of the steam velocity which is lead off to the guide blading 4 will behave in a substantially constant manner throughout the entire curved section 3''. Provision is also made for the fact that the steam obtains radial components of steam velocity not only due to the specific curvature but also due to its expansion. Naturally, the tangential and/or radial components of the steam velocity need not always behave in a constant manner and it would be feasible to provide variations to meet specific requirements by a suitable design of the curved section 3'' in the direction of steam flow.

The cross-sectional areas 18 of the curved sections 3'' comprise each one rectangular first section 19 which is open in the direction of the guide blading ring 4 and which remains constant in the direction of steam flow, followed by a second section 20, having a configuration similar to the segment of a circle and which decreases in cross-section in the direction of steam flow through it. However, these depicted configurations for the sections 19 and 20 are not an absolute requirement, and it is feasible to design the sectional areas 18 in consideration of special needs.

Within the separation plane 15 the cross sectional area 18 will possess the configuration depicted in FIG. 2, its size being smaller than one-third of its maximum size. This feature is particularly important because it leads to significant spatial advantages, and because this arrangement allows in an easy manner sufficient space for the connection flange 21 which is required at the separation plane 15.

There is attained the additional advantage that the forces which tend to pull the two parts of the inflow housing 1 away from each other are much smaller than in the case of the previously known constructions because the steam velocities within the intake ducts 3, designed in accordance with the present invention, are higher than within the known torus-configured intake duct, thus permitting the use of smaller maximum cross sectional areas 18 of the curved sections 3''. Consequently, a smaller number of bolts and/or smaller sized bolts are needed to secure the parts of the inflow housing 1 together.

The inflow housing 1 and the guide blading carrier ring 22, see FIG. 2, are manufactured in one piece and which will support the entire multi-stage guide blading system, with the exception of the last stage. Therefore, there are provided a total of only three guide blading carriers which includes the carriers 23, 24 carrying the blading of the last stages of each half of the turbine. The center guide blading carrier 22 is provided with two bleed chambers 25, 26 arranged within its walls and designed circularly, their axes coinciding with the turbine axis, and which are independent of the inner housing 2. These bleed chambers each of which is associated with a corresponding half of the turbine will extract steam from the various stages so that the steam conditions in the two chambers will differ. They are much smaller in profile than the corresponding bleed chambers 10, 11 of the FIG. 1 structure, resulting therefore in a considerable savings in space. Also, the separating walls 12, 13 and 14 shown in FIg. 1 can be omitted since they are no longer necessary, and the steam present in bleed chambers 25, 26 will not exert any stress on the inner housing 2.

The enlarged detailed view in FIG. 3 also shows the two inlet nozzles 27, one each connected in a gas-tight manner to the inflow side of one of the parts of the inflow housing 1, the bore 28 of each nozzle turning into the inflow section 3' of the inflow duct 3. The other end of the inlet nozzle passes through the inner housing 2 and seals at the same time the bleed chamber 45, FIG. 2, heat-flexibly against the exhaust steam chamber 46, FIGS. 4–5, which is located between the inner housing 2 and the outer housing 32, this chamber 45 being the only bleed chamber present within the inner housing 2 and extracting its steam from the guide blading channel next to the penultimate stage. The inlet nozzle 27 carries guide vanes 29 which deflect the horizontal inflow of the steam in the direction of the inflow duct 3.

Additional follow-up arrangements of the turbine construction in accordance with the invention concern the advantageous placement of the steam supply pipe system leading to the low-pressure turbine which is made possible. FIGS. 4 and 5 depict such advantageous placement of the steam supply piping. Between the inlet nozzles 27 and the water separators-intermediate superheaters 30 there extend the pipings 31 which consists of several sections. The pipings include compensators 34, 36 and 39 to absorb the heat expansions, also controllable flaps 37 operated by servo-motors for adjusting the quantity of steam, and also closing flaps 38 by which to cut off the steam. The final section 33 of the pipings 31 passes in each given case through the outer housing 32 of the turbine, with an elastic but gas-tight and heatflexible connection existing between the last and first mentioned parts.

FIG. 4 shows the horizontal section 35 of piping 31 arranged above the level of the turbine axis so that an operator, as depicted by the stick figure, can walk with ease under this section. This is particularly important in the case of atomic power plants because an operator can stay within the turbine area for a limited period of time only in view of the danger to him of contamination by radio-active steam, and an unrestricted movement is essential.

In the FIG. 5 construction, on the other hand, the final sections 33 and the horizontal sections 35 of piping 31 extend approximately level with the turbine axis, thereby keeping the steam deflection low and thus the deflection losses low.

FIGS. 4 and 5 also illustrate the outer housing 32 comprising the supporting frame 41 and an outflow hood 42 arranged above the frame. The outflow hood 42 consists of two halves which are connected with each other in a gas-tight manner within a vertically extending plane 43 and which can be slid apart to facilitate inspection. The separation plane 44 between the outflow hood 42 and supporting frame 41 is located above the turbine axis at such height that it will be possible to open the outer housing 32, i.e. to move apart the two halves of the outflow hood unrestrictively.

In the case of the embodiment of the low-pressure steam turbine as illustrated in FIG. 6, the inflow housing 1 consists of two dissimilar parts which are connected with each other within the separation plane 15 and which form the boundaries for one single intake duct 3. This duct is likewise divided within the separation plane 15 into two dissimilar crescent-shaped sections 3'' and is used to supply steam to the entire perimeter of the first row of guide blading. The illustrated portion of the piping 31 extends vertically within the outflow hood 42 designed accordingly.

As in the case of the construction shown in FIG. 3, the cross section of the crescent-shaped intake duct 3'' diminishes continuously in the direction of steam flow through it and in the same direction as that in which the turbine rotor turns.

We claim:

1. A low pressure multi-stage axial flow steam turbine comprising an outer housing, an inner housing structure constituting a carrier for the rows of guide blading of the turbine stages, a rotor having rows of blading for receiving steam from the rows of guide blading, an inflow housing comprising at least two separable parts which form the boundaries of a crescent-shaped intake duct surrounding and admitting steam to the first stage guide blading and which flows through the duct in the same direction as the direction of rotor rotation, the cross sectional profile of said crescent-shaped intake duct being constituted by a radially inner portion of rectangular configuration opening in the direction of the first stage guide blading and which merges into a second portion having a circular configuration which progressively decreases in diameter in the direction of steam flow therethrough such that the tangential components of the steam velocity conform to a first predetermined function and wherein the value of the curvature at the inner periphery of said intake duct increases progressively in the direction of the steam flow therethrough such that the radial components of the steam velocity conform to a second predetermined function.

2. A low-pressure steam turbine as defined in claim 1 wherein said first and second functions are correlated such that the tangential and radial components of the steam velocity are at least approximately equal to each other for the same cross sectional locations along the intake duct.

3. A low-pressure steam turbine as defined in claim 1 wherein said first and second functions are correlated such that the tangential and radial components of the steam velocity increase in the direction of steam flow through the intake duct.

4. A low pressure multi-stage axial flow steam turbine comprising an outer housing, an inner housing structure constituting a carrier for the rows of guide blading of the turbine stages, a rotor having rows of blading for receiving steam from the rows of guide blading, an inflow housing comprising two separable halves meeting in a common separation plane, each half of said inflow housing including a crescent-shaped intake duct surrounding and admitting steam to the first stage guide blading and which flows through the duct in the same direction as the direction of rotor rotation, each said intake duct terminating in a top and defining a second plane within which are located the axis of the turbine and said tops of said intake ducts said second plane forming an acute angle with said separation plane of the two halves of the inflow housing, and the cross sectional area of said intake ducts decreasing progressively in the direction of the steam flow therethrough such that the tangential components of the steam velocity conform to a first predetermined function and wherein the value of the curvature at the inner periphery of said intake ducts increases progressively in the direction of the steam flow therethrough such that the radial components of the steam velocity conform to a second predetermined function.

* * * * *